US006839934B2

(12) United States Patent
Houghton et al.

(10) Patent No.: US 6,839,934 B2
(45) Date of Patent: Jan. 11, 2005

(54) MULTI-OPERATIONAL BATTERY POWERED VACUUM CLEANER

(75) Inventors: Stephen Houghton, Newcastle upon Tyne (GB); Barry Pears, Langley Moor (GB); Daniel W K Hong, Kowloon (HK)

(73) Assignee: Black & Decker Inc., Neward, DE (US)

( * ) Notice: Subject to any disclaimer, the term of this patent is extended or adjusted under 35 U.S.C. 154(b) by 322 days.

(21) Appl. No.: 10/096,344

(22) Filed: Mar. 12, 2002

(65) Prior Publication Data

US 2003/0019072 A1 Jan. 30, 2003

(30) Foreign Application Priority Data

Jul. 25, 2001 (GB) ..... 0118141

(51) Int. Cl.[7] ..... A47L 5/26
(52) U.S. Cl. ..... 15/329; 15/328; 15/344
(58) Field of Search ..... 15/328, 329, 331, 15/344

(56) References Cited

U.S. PATENT DOCUMENTS

| | | | |
|---|---|---|---|
| 2,230,077 | A | 1/1941 | Foss |
| 2,346,339 | A | 4/1944 | Vose |
| 2,473,066 | A | 6/1949 | Miller |
| 2,851,717 | A | 9/1958 | Kasper |
| D192,555 | S | 4/1962 | Jepson et al. |
| D208,627 | S | 9/1967 | Bonzer |

(List continued on next page.)

FOREIGN PATENT DOCUMENTS

| | | |
|---|---|---|
| CA | 2087056 | 7/1994 |
| DE | 564003 | 11/1932 |
| DE | 1839536 | 10/1961 |
| DE | 7929844 | 10/1979 |
| DE | 90G3239 | 10/1991 |
| DE | 90G3591 | 5/1992 |
| DE | 19734356 | 8/1997 |
| DE | 19739377 | 9/1997 |
| DE | 19630286 | 1/1998 |
| EP | 0294600 | 8/1993 |
| EP | 0893962 | 2/1997 |
| EP | 0788757 | 8/1997 |

(List continued on next page.)

OTHER PUBLICATIONS

Powermaxx Dustbuster and Powermaxx Dustbuster Plus Wet and Dry Cordless Vac 1989.
Search Report from United Kingdom Patent Office, dated Sep. 27, 2001.
Search Report from European Patent Office, dated Nov. 22, 2002.
International Search Report dated Dec. 2, 2002.

*Primary Examiner*—Theresa T. Snider
(74) *Attorney, Agent, or Firm*—Harness, Dickey & Pierce, P.L.C.

(57) ABSTRACT

A multi-operational battery powered vacuum cleaner (1) comprising a hand held vacuum cleaner (1) releasably mounted within a caddy (15) which has a detachable handle (51) and a floor engaging head (19). The hand held unit (1) may be released from the caddy to be used in a first hand held operation. It may alternatively be mounted within the caddy with the handle attached for use as an upright vacuum cleaner in a second operational mode. In a third operational mode the handle (51) may be removed from the caddy while the hand held unit remains mounted in the caddy to provide a compact vacuum cleaner system with a floor engaging head (19). The cleaner further comprises a first spring biased latch member (27) mounted within the caddy (15) to releasably restrain the hand held unit therein A second latch member (53) is mounted within the handle (57) for releasably connecting the handle to the caddy (15).

28 Claims, 12 Drawing Sheets

U.S. PATENT DOCUMENTS

| | | | | | |
|---|---|---|---|---|---|
| D212,829 | S | | 11/1968 | Kraines | |
| 3,667,084 | A | | 6/1972 | Valbona et al. | 15/323 |
| D247,341 | S | | 2/1978 | Pelly | |
| D253,452 | S | | 11/1979 | Tack | |
| 4,249,280 | A | | 2/1981 | Goodrich | 15/323 |
| D259,618 | S | | 6/1981 | Tack | |
| 4,467,493 | A | | 8/1984 | Buchtel | 15/323 |
| D280,033 | S | | 8/1985 | Miyamoto et al. | |
| D280,452 | S | | 9/1985 | Arita | |
| 4,545,089 | A | | 10/1985 | Oxel | 15/323 |
| 4,573,237 | A | | 3/1986 | Kochte et al. | 15/344 |
| 4,635,315 | A | * | 1/1987 | Kozak | 15/329 |
| 4,644,605 | A | | 2/1987 | Joss et al. | 15/329 |
| D289,576 | S | | 4/1987 | Okada et al. | |
| D290,894 | S | | 7/1987 | Miyamoto et al. | |
| 4,766,638 | A | | 8/1988 | McDowell | 15/329 |
| D298,875 | S | | 12/1988 | Nakamura | |
| 4,841,594 | A | | 6/1989 | Elson et al. | 15/344 |
| D307,657 | S | * | 5/1990 | Li | 15/329 |
| 4,928,346 | A | | 5/1990 | Elson et al. | 15/338 |
| 5,524,321 | A | * | 6/1996 | Weaver et al. | 15/329 |
| 5,819,364 | A | | 10/1998 | Sham | 15/320 |
| 6,094,775 | A | * | 8/2000 | Behmer | 15/329 |
| 6,108,864 | A | * | 8/2000 | Thomas et al. | 15/329 |

FOREIGN PATENT DOCUMENTS

| | | |
|---|---|---|
| EP | 0853917 | 1/1998 |
| EP | 1 070 478 | 1/2001 |
| EP | 0900045 | 7/2001 |
| GB | 2126471 A | 3/1984 |
| GB | 2 291 790 | 2/1996 |
| GB | 2 343 837 | 5/2000 |
| JP | 10-225403 | 8/1998 |
| WO | WO 86/01703 | 3/1986 |
| WO | WO 9732511 | 9/1997 |

* cited by examiner

MULTI-OPERATIONAL BATTERY POWERED VACUUM CLEANER

TECHNICAL FIELD

This invention relates to a battery powered hand-held vacuum cleaner, and in particular to such a vacuum cleaner used in combination with other component parts to provide a multi-operational vacuum cleaner.

BACKGROUND OF THE INVENTION

A typical known battery powered hand-held vacuum cleaner is described in EP-A-1070478. It comprises a generally conical nosepiece containing the air flow inlet at its tip and the dust collection module, a main housing portion behind the nosepiece containing the fan, motor and rechargeable battery pack, and an integrally moulded handle on its upper surface. The vacuum cleaner is typically wall mounted when not in use on a recharging mount so that the cleaner is perpetually in a state of high battery charge. The cleaner is hand-held and relatively small, and is typically used for collecting small amounts of dust or debris. Its small size and hand-held nature mean it is particularly useful for collecting dust or debris from raised or difficult to access locations. For normal floor use the operator must bend to place the cleaner in contact with the floor, and for floor cleaning use of an upright vacuum cleaner may be a more suitable choice.

Typically upright vacuum cleaners comprise a floor travelling head comprising an air inlet and a rotating brush which dislodges dust or debris, the brush usually being positioned in or close to the air inlet. In upright vacuum cleaners the functional components such as the motor, fan and dust collection modules are typically contained either in the floor travelling head, or in an upwardly extending main housing portion. Upright cleaners generally also comprise a handle connected to the floor travelling head or the main housing portion if present, the length of the handle being chosen to allow the operator to move the floor travelling head using the handle from a standing position.

U.S. Pat. No. 4,766,638 (BISSEL) discloses a conversion mechanism for a hand-held vacuum cleaner by plugging in a floor engaging head directly into the nozzle of the hand-held cleaner and further attaching an elongate stick handle directly to the handle of such hand-held vacuum cleaner to create an upright vacuum cleaner. However, in such a situation the elongate handle mounted in the cleaner directly creates a high concentration of stress within the handle of the vacuum cleaner, together with the high degree of stress between engagement of the vacuum cleaner with the floor engaging head. Thus a vacuum cleaner according to this prior art could be subject to damage if undue force is applied to the handle. Attempts to overcome the deficiency of the Bissel invention have been addressed by the Applicant's own product range by the launch of its System 3.TM. combined hand-held vacuum cleaner and caddy system during the mid 1990s. Such a system involved the use of a caddy with a pivotable floor engaging head for receiving the hand-held vacuum cleaner to convert the hand-held vacuum cleaner into a cleaner with a floor engaging head, and which caddy further accommodated an elongate cylindrical handle mounted within the caddy and which could be extended therefrom. However, the drawbacks of this system involved the necessity of a rather bulky caddy to accommodate the elongate handle when its fitted in a stored position, whereby even in the stored position a portion of the elongate handle remained projecting externally of the caddy thereby increasing the length of the unit which could result in the restriction of where such a unit could be used since the additional length of the projecting handle, even in the stored position, increased the overall length of the caddy mounted hand-held unit making it more bulky and difficult to use in restricted areas. The present invention now seeks to overcome the problems associated with these earlier vacuum cleaner systems.

SUMMARY OF THE INVENTION

We have designed a new vacuum cleaner which uses a hand-held vacuum cleaner that is essentially the same in design as known hand-held vacuum cleaners, but which can be used in combination with other component parts so as make the hand-held vacuum cleaner optionally convertible by the user into a different vacuum cleaner for different applications. In particular we have designed a new vacuum cleaner which comprises a hand-held vacuum cleaner and other component parts making it possible to make three different vacuum cleaners from different combinations of the component parts.

The present invention provides a multi-operational battery powered vacuum cleaner comprising:

(a) a hand held vacuum cleaner comprising a nose cone containing an air flow inlet, and a handle;

(b) a support caddy comprising a support member to which the hand held vacuum cleaner can be detachably secured, and a floor cleaning head attached to the support member; and (c) an upper handle portion that can be detachably secured to the support caddy;

wherein the vacuum cleaner can operate: (i) in a first mode as a hand-held vacuum cleaner alone; (ii) in a second mode with the hand-held vacuum cleaner secured to the support caddy; or (iii) in a third mode as (ii) additionally with the upper handle portion secured.

As mentioned briefly above the present invention therefore advantageously allows the operator to choose which component parts to put together so that three vacuum cleaners can be made, the selection depending on the application. The present invention therefore provides three vacuum cleaners in one. First the operator can choose to use the vacuum cleaner as a hand held vacuum cleaner alone. This would be suitable for example for picking up small amounts of dust or debris or in awkward to reach locations. Secondly the operator can choose to use the vacuum cleaner as a short handled vacuum cleaner with a traditional floor cleaning head, with the hand held vacuum cleaner attached to the caddy. The arrangement is preferably such that air flow passes through the floor cleaning head and into nose cone of hand held vacuum cleaner. Selection of this mode of operation may be useful, for example, for removal of larger amounts of dust or debris on raised surfaces, or on stairs or the like. Thirdly the operator may choose to secure the upper handle portion thereby effectively creating an upright vacuum cleaner, with a floor cleaning head, which can be used by the operator in a standing position. All three modes of operation of vacuum cleaner are advantageously powered by the hand-held vacuum cleaner component, and the dust or debris is collected within the dust collection module of the hand-held vacuum cleaner component.

Preferably for ease of operation the floor cleaning head is pivotally connected to the support member of the support caddy. The support member is preferably substantially elongate, and preferably substantially flat for receipt of the hand-held vacuum cleaner, which is similarly preferably substantially flat based.

Preferably the floor cleaning head comprises a rotatable brush. This may be rotated mechanically by movement of the floor cleaning head over the floor, or may be powered by the battery of the hand-held vacuum cleaner, appropriate electrical connections being provided in the respective parts.

In one embodiment attachment tools are preferably provided, stored in a tool holding assembly in the upper handle portion.

The hand-held vacuum cleaner may itself comprise a handle. This may act as the handle of the vacuum cleaner when the hand-held vacuum cleaner is used alone, and also when it is used in the second mode in combination with the support caddy Preferably latch members are provided to releasably secure the hand-held vacuum cleaner to the support caddy, and the support caddy to the upper handle portion, so that the operator can readily change the vacuum cleaner between its different modes of operation.

In one embodiment the hand-held vacuum cleaner is detachably secured to the support caddy by a first spring-biased latch member, the spring of the first spring-biased latch member being movable from an uncompressed to a compressed state. While a spring biased latch member is preferred, other resilient member latch members may also be used, and where reference is made to spring-biased latch members the reader will appreciate that another resilient member could replace the spring. Preferably the first spring-biased latch member is located in the support caddy, and the hand held vacuum cleaner comprises a recess shaped to receive the first spring-biased latch member when the spring is in its uncompressed state. Preferably the spring of the first spring-biased latch member can be compressed to allow the first spring-biased latch member to be released from the latch-receiving-recess of the hand-held vacuum cleaner so that the hand-held vacuum cleaner can be detached from the support caddy.

In order to compress the spring of the first spring-biased latch member of the support caddy, the latch member preferably comprises a first cam surface, and a first release member comprising a co-operating second cam surface is also provided on the support caddy, whereby the release member can be moved relative to the first spring-biased latch member so that the first and second cam surfaces slide relative to each other to cause the spring of the first spring-biased latch member to move from its uncompressed to its compressed state. Preferably the release member is a depressible button that can be depressed by an operator, depression of the button causing the first and second cam surfaces to move relative to each other.

In one embodiment where the hand-held vacuum cleaner comprises a latch receiving recess, this is contained in the rear end of the hand-held vacuum cleaner, remote from its nose cone. Preferably the support caddy has a lower end and an upper end, and the lower end of the support caddy comprises a nose engaging projection for engaging the nose cone of the handheld vacuum cleaner.

Preferably in order to install the hand-held vacuum cleaner in the support caddy the nose cone of the vacuum cleaner is first mounted on the nose engaging projection at the lower end of the support caddy, then the spring of the first spring-biased-latch member is compressed and positioned in line with the latch-receiving recess of the hand-held vacuum cleaner, and then the spring is released so that the latch engages the said recess; and to release the retained hand-held vacuum cleaner the spring of the first spring-biased latch member is compressed so that the latch disengages the latch-receiving-recess of the hand-held vacuum cleaner.

Preferably the spring compression required to insert the handheld vacuum cleaner is effected simply by the hand-held vacuum cleaner pushing against the projecting first latch member, and preferably spring compression required to remove the installed hand-held vacuum cleaner is effected by action of the separate release member, preferably the depressible release button as described above.

While the preferred embodiments described so far have a latch in the support caddy and a recess in the hand-held vacuum cleaner, reverse designs in which the latch is in the hand-held vacuum cleaner and a co-operating recess is in the support caddy are also envisaged.

As mentioned above, the upper handle portion is preferably also detachably secured to the support caddy by a second spring-biased latch member. The design of this second latch member is preferably as a central spring and at least one, but preferably two, end caddy-engaging portions on either side of the spring. Preferably the second spring-biased latch member is located in the upper handle portion and the support caddy comprises at least one, but preferably two, recesses adapted to receive the caddy-engaging portions of the second spring-biased latch member. Reversed designs in which the second spring biased latch member is located in the support caddy and the recesses in the upper handle portion are also envisaged. In an especially preferred design, the support caddy comprises an upper end and the upper handle portion comprises a lower end containing the second spring-biased latch member, and the upper end of the support caddy comprises a slot adapted to receive part of the lower end of the upper handle portion containing the second spring-biased latch member. The vacuum cleaner preferably also comprises a second release member which can be moved relative to the second spring biased latch member to cause the spring of the second spring-biased latch member to move from its uncompressed to its compressed state. This movement can be effected by co-operating cam surfaces. Preferably the second spring biased latch member comprises a third cam surface which slides relative to a fourth cam surface on the second release member to cause the spring of the second spring-biased latch member to move from its uncompressed to its compressed state. Preferably the second spring-biased latch member comprises a central spring and two end caddy-engaging portions and two third cam surfaces are provided on the second spring-biased latch member, one on each of the two end caddy-engaging portions of the second spring-biased latch member. In one design two fourth cam surfaces are provided on the second release member to co-operate with respective ones of the two third cam surfaces on the second spring-biased latch member. The or each fourth cam surface is preferably provided as a projecting surface on a back plate which can be moved relative to the second spring-biased latch member. In one embodiment, the second spring-biased latch member additionally comprises a slideable button that can be slid by an operator, and movement of the co-operating third and fourth cam surfaces is effected by sliding the button.

Preferably the second latch member spring compression required to insert the upper handle portion in the support caddy is effected simply by part of the support caddy pushing against the latch member that is contained in the upper handle portion; and preferably spring compression required to remove the upper handle portion is effected by action of the separate release member, preferably the slidable release button as described above.

DESCRIPTION OF THE DRAWINGS

Embodiments of the present invention will now be described, by way of example, with reference to the accompanying drawings wherein.

DETAILED DESCRIPTION OF THE PREFERRED EMBODIMENTS

Figure 1:
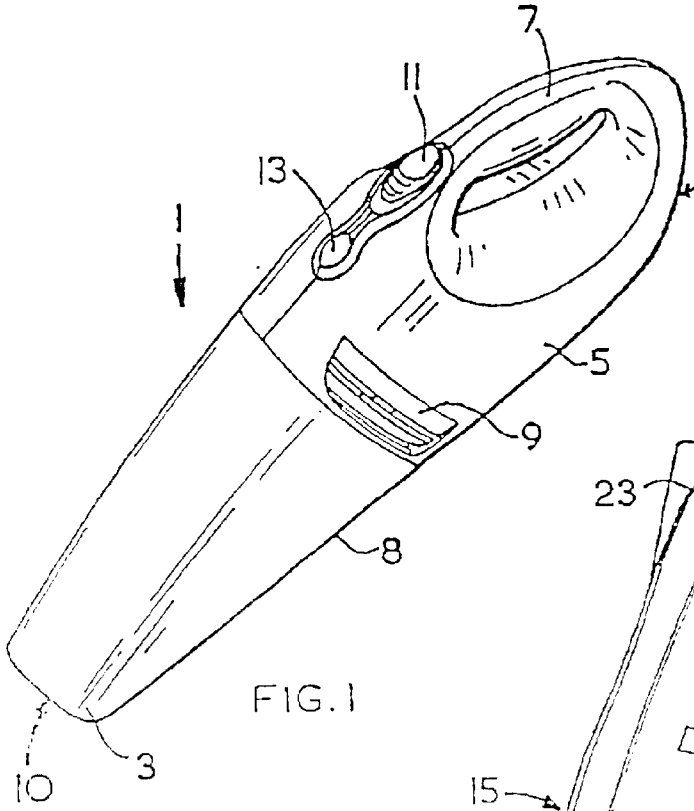
FIG. 1 is a perspective view showing a hand-held vacuum cleaner which is part of a multi-operational vacuum cleaner according to the present invention.

Referring now to the drawings, FIG. 1 shows a hand-held vacuum cleaner 1 comprising a nose cone 3, a main housing portion 5 and a handle 7. The base 8 of the hand-held vacuum cleaner 1 is substantially flat. The air flow inlet into the vacuum cleaner (not visible in FIG. 1 but indicated by the dotted reference arrow 10) is at the end of the nose cone 3, and the nose cone 3 also acts as a dust collection module. The main housing portion 5 contains the functional components of the vacuum cleaner including a motor, a fan, and rechargeable batteries to power the motor. Air flow outlets 9 are provided on the sides of the main housing portion 5. These surround the fan (not visible). On/off switch 11 is provided on the upper surface of the main housing portion 5 and a depressible button 13 is provided to releasably secure the nose cone portion 3 to the main housing portion 5, so that the nose cone can be removed for emptying the dust collection module. The hand-held vacuum cleaner 1 also contains a recess (not visible, but indicated by the hashed arrow 14) at its rear end. This is for securement to the support caddy component of the vacuum cleaner as described in more detail below.

The hand-held vacuum cleaner of FIG. 1 may be exactly as described in EP-A-1070478 or as described in co-pending GB Patent Application Number 0113385.9, filed 1 Jun. 2001 by common applicant, the entire disclosure of which is incorporated herein by reference.

The hand-held vacuum cleaner 1 of FIG. 1 is one of the components of the multi-operational vacuum cleaner of the invention. As shown and used in FIG. 1 it represents the first mode of operation of the multi-operational vacuum cleaner.

Figure 2:
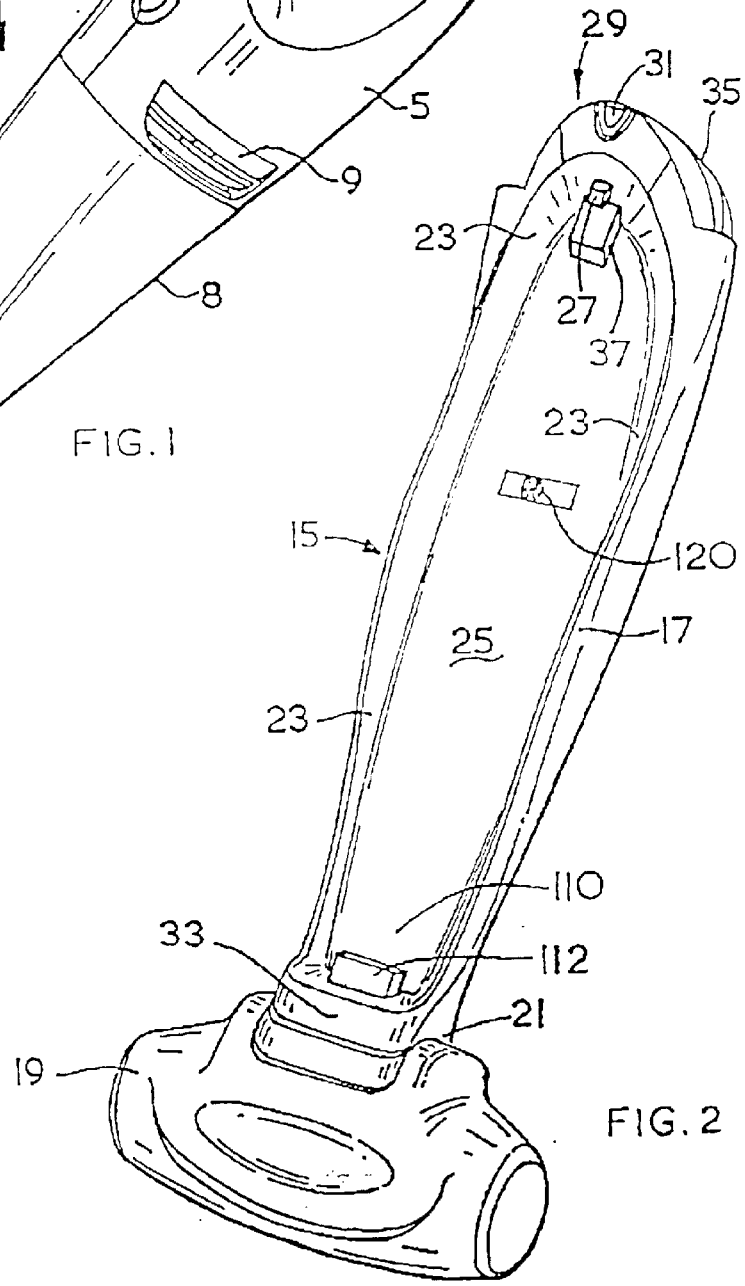
FIG. 2 is a perspective view of a support caddy which is another component of a multi-operational vacuum cleaner according to the present invention, and can be used in conjunction with the hand-held vacuum cleaner of FIG. 1.

FIG. 2 shows a support caddy 15, which is a second component of vacuum cleaner according to the invention. Since the support caddy 15 has no power source, it can not be used alone, but can be used in combination with the hand-held vacuum cleaner of FIG. 1 to provide the vacuum cleaner of the present invention operating in its second mode. This is described in more detail later with reference to FIGS. 3 to 5.

Figure 2A:
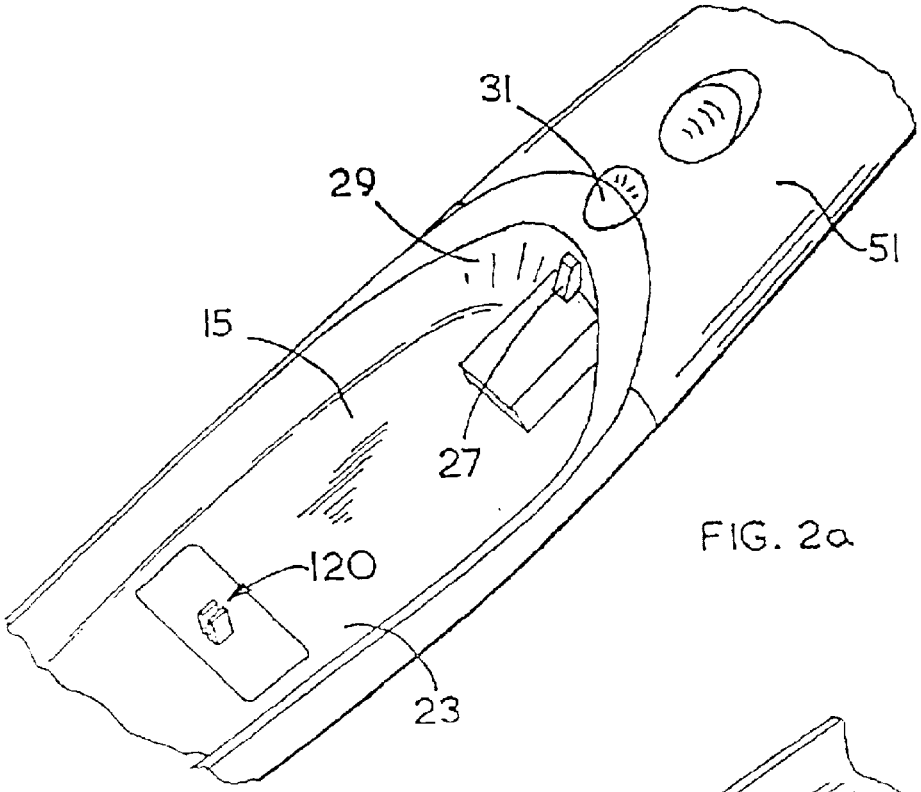
FIG. 2*a* is a magnified perspective view of the end region of the support caddy of FIG. 2 when connected to a handle.
Figure 2B:
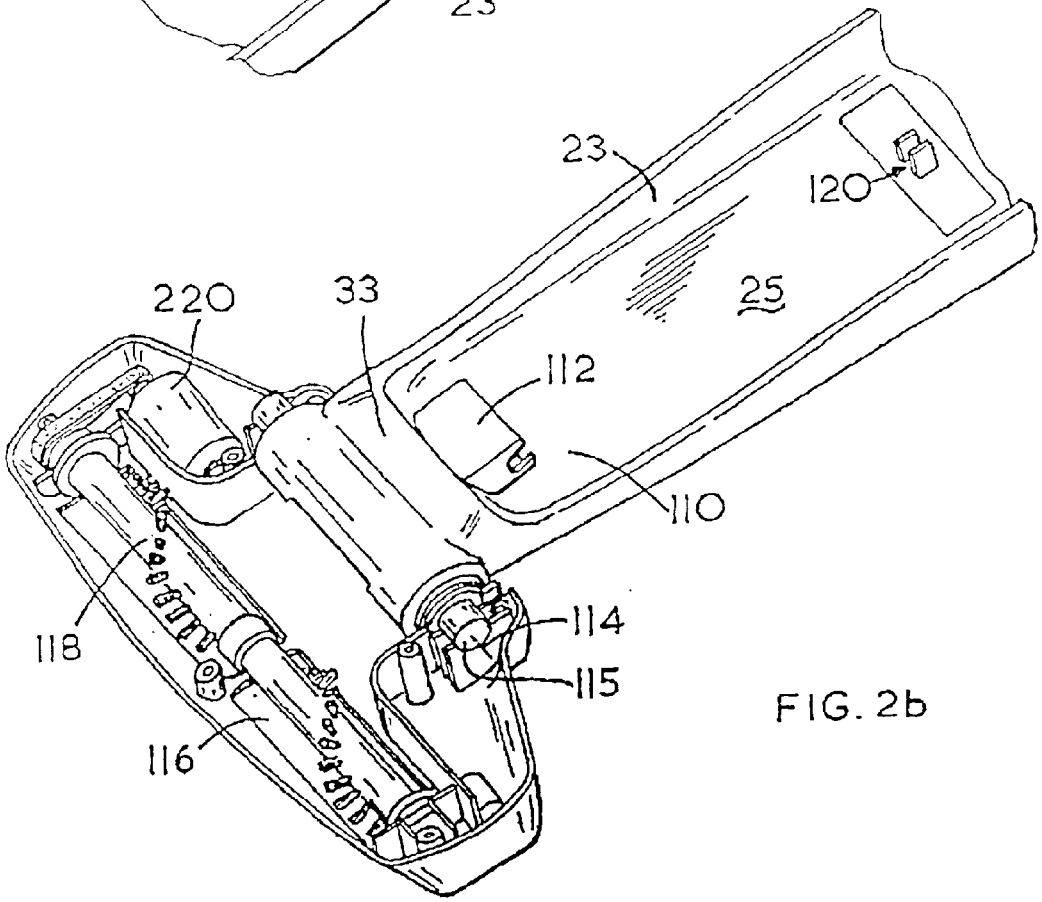
FIG. 2*b* is a magnified perspective view of the lower end of the support caddy of FIG. 2, with the upper clamshell of the floor cleaning head removed.

Looking in more detail at FIGS. 2, 2*a* and 2*b*, the support caddy 15 comprises a substantially elongate and substantially planar support member 17 and a floor cleaning head 19 attached pivotally at one end 21 of the support member 17. The support member 17 of the support caddy 15 is generally recessed around its edges 23 and provides a substantially flat backed central portion 25 for complementary receipt of the substantially flat base 8 of the hand-held vacuum cleaner 1 of FIG. 1. A retractable first latch member 27 is contained in the recessed region 23 towards the upper or rear end 29 of the support caddy 15. This first latch member 27 can be retracted into the support caddy by depression of button 31 at the rear end 29 of the support caddy 15. If button 31 is not depressed, or latch member 27 is not pushed against, then the latch member 27 projects out of the surface of the support caddy 15. The purpose of the first latch member 27 is to latch into the recess 14 of the hand-held vacuum cleaner 1 of FIG. 1.

Figure 2C:
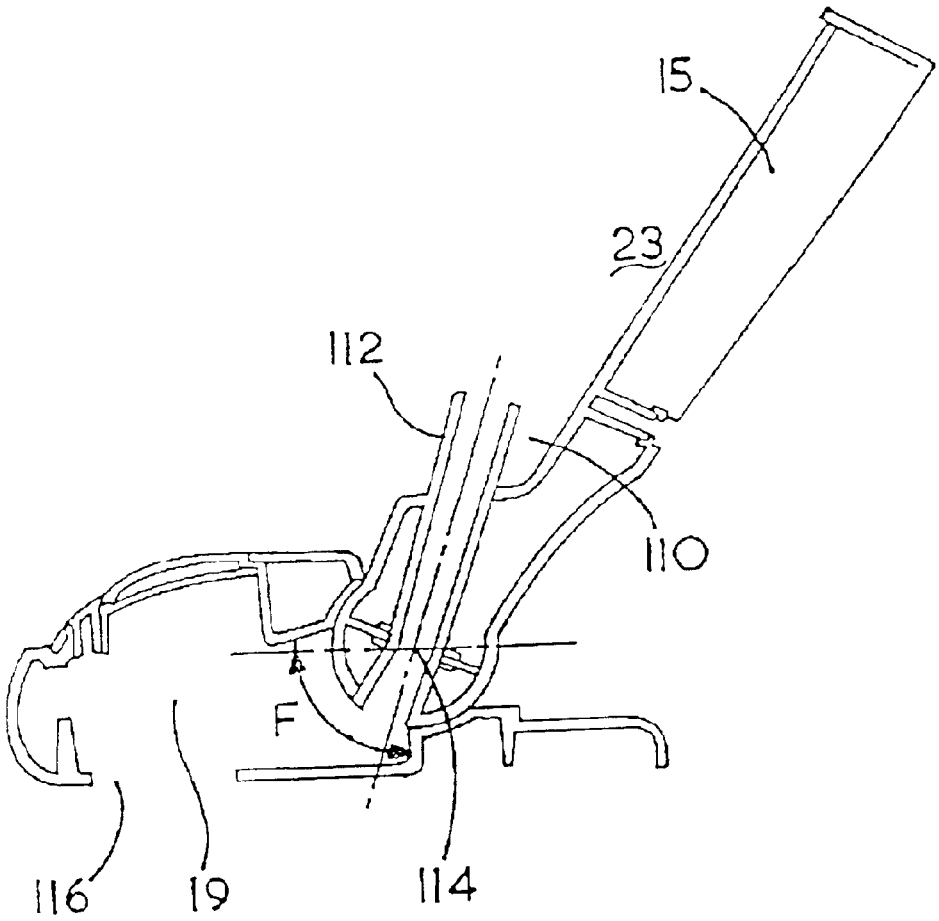
FIG. 2*c* is a schematic cross-section through the lower caddy and floor travelling head of FIG. 2.

Referring to FIG. 2*b*, the lower end portion 110 of the caddy 15 further comprises a male projection 112 extending into the recess region 23 from a front support bar 33. This projection 112 (as best seen in FIG. 2*c*—which is a schematic cross-section through the floor travelling head 19 and caddy 15) is substantially hollow having a substantially rectangular cross-section, providing a fluid communication channel from the recessed region 23 into the interior of the floor travelling head 19. Again as seen in FIG. 2*c*, the upper portion of the caddy 15 is pivotally mounted to the floor travelling head along an axis 114 by conventional use of two pivot members 115 (FIG. 2*b*), the caddy member 15 being accommodated within circular trunions formed integrally with the internal clamshell of the floor travelling head 19. This arrangement allows the head 19 to pivot relative to the caddy 15. As can be seen in FIG. 2*c*, the fluid communication of the projection 112 is thus permitted to travel through an angular range defined as F and remain in fluid communication with the interior of the floor travelling head 19. The interior of the floor travelling head 19 is substantially hollow to provide further fluid communication from the projection 112 with a suction inlet 116 on the under surface of the head 19. Thus, fluid communication is achieved between suction inlet 116 and the recessed region 23 of the caddy 15. Furthermore, as can be seen from FIG. 2*b*, the floor travelling head 19 comprises a conventional beater bar 118 mounted within the suction inlet 116 so as to agitate dirt from any surface being vacuumed. The beater bar 118 is driven by a motor 220 which is in electrical contact, by means of wires extending through the axles 115, with electrical contact 120 within the central portion 25.

When the hand-held vacuum cleaner 1 of FIG. 1 is inserted to engage with the caddy 15 the nosecone 3 is manoeuvred towards the lower end 110 of the caddy 15 so as to bring the airflow inlet 10 into contact with the projection 112 for the projection 112 and the caddy 15 to be received in a complementary and friction fit within the inlet 10 of the cleaner 1. Not only does this provide fluid communication between the suctions of the vacuum cleaner and the floor travelling head but also serves to orientate the cleaner 1 in a correct insertion position with the caddy 15 which can then be pushed into the recessed region 23 of the support caddy 15 (FIG. 2), serving the rear end of the cleaner 1 to automatically engage with the latch 27 which is automatically pushed back against its natural biasing (i.e. retracted). Further insertion of the cleaner into the caddy 15 will then bring a complementary aperture on the cleaner 1 into orientation with the projection 27 for such projection to snap engage therewith as will be described later. When it is desired to withdraw the hand-held vacuum cleaner, button 31 is depressed which acts to retract the latch 27 out of engagement with the recess in the cleaner 1 allowing removal of the hand-held vacuum cleaner. Retraction of the latch member 27 by such depression of button 31 will be described in more detail below with reference to FIG. 6.

In this manner, it will be appreciated that the projection 112 and latch member 27 serve to restrain the cleaner 1 in the caddy 15 whereby the support member 17 also serves to orientate and retain the cleaner within the caddy 15.

The support caddy 15 has the raised rear end 29 extending substantially perpendicular to the elongate central portion 25, which further comprises from its inner surface a rear end inlet 35 and in its outer surface a substantially rectangular elongate member 37 extending within the central portion 25 of the caddy 15 from this rear end 29. A corresponding rebate is formed on the underside of the rear of the cleaner 1 for complementary engagement with member 37 when the cleaner is mounted in the caddy 15. The member 37 and the inlet 35 are features required for retention of a removable handle portion 51 of the multi-operational vacuum cleaner of the present invention and will be described in more detail later with reference to FIGS. 7 to 9*b*.

Furthermore, it will be appreciated that the hand-held vacuum cleaner 1 employs rechargeable batteries to drive its internal motor whilst the power for this combined vacuum cleaner system is derived from such rechargeable batteries. To this end, the caddy 15 comprises the electrical contact 120 which is received by a co-operating electrical connecting portion (not shown) in the vacuum cleaner in a manner which is conventional for providing an electrical connection between a storage caddy and a hand-held vacuum cleaner (and as such will not be described in detail further). However, as is conventional within the art, the electrical contact 120 can serve to both connect the hand-held vacuum cleaner to an external power source (via an external connecting lead which can be connected to the caddy) for recharging purposes, whilst it can also serve to provide an electrical connection between the hand-held cleaner and the motor within the floor cleaning head 19 to provide a power source to the beater bar. Such an arrangement is standard within the field of hand-held vacuum cleaners and portable caddy systems.

Figure 3:
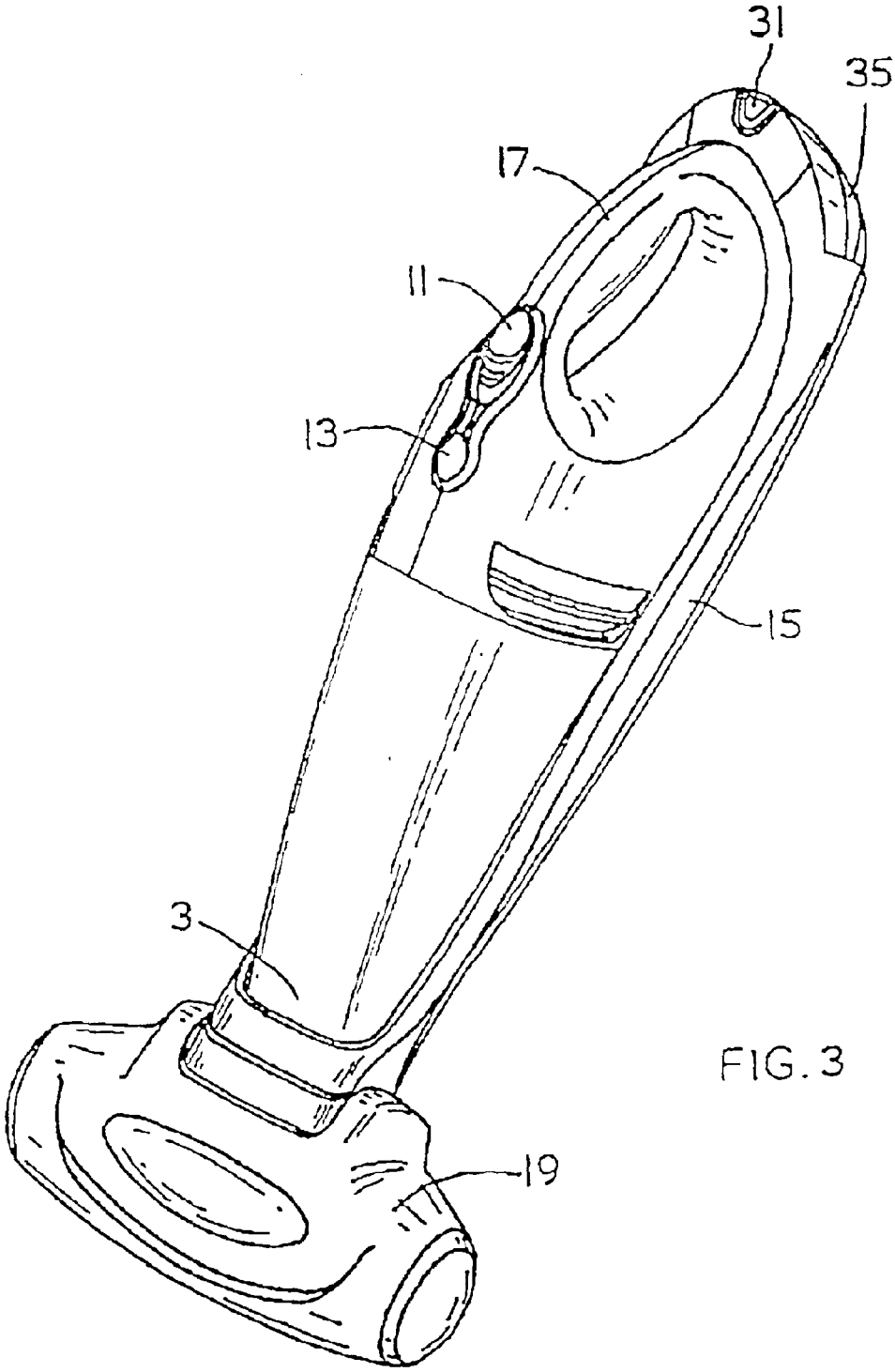
FIGS. 3, 4 and 5 are perspective view of the upper side, underneath side, and rear end respectively of the hand-held vacuum cleaner of FIG. 1 installed in the support caddy of FIG. 2.
Figure 4:
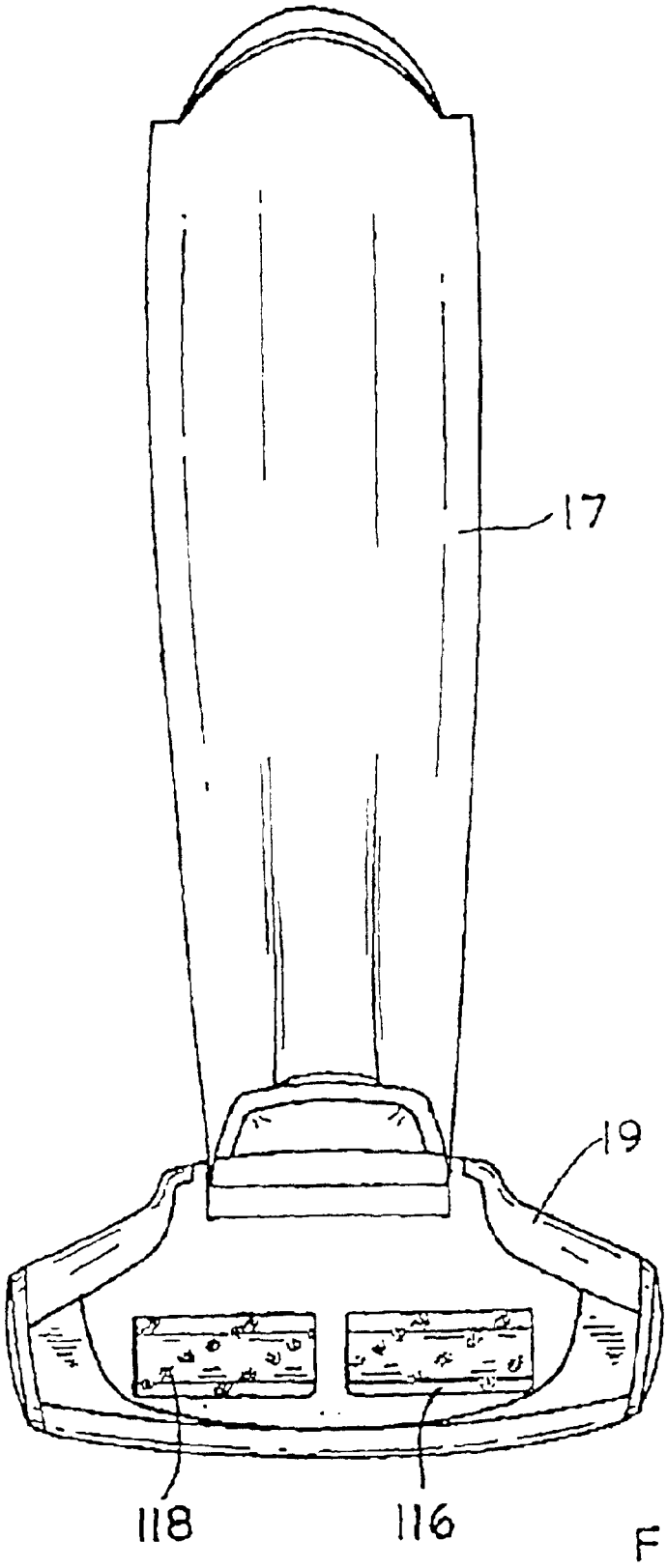
Figure 5:
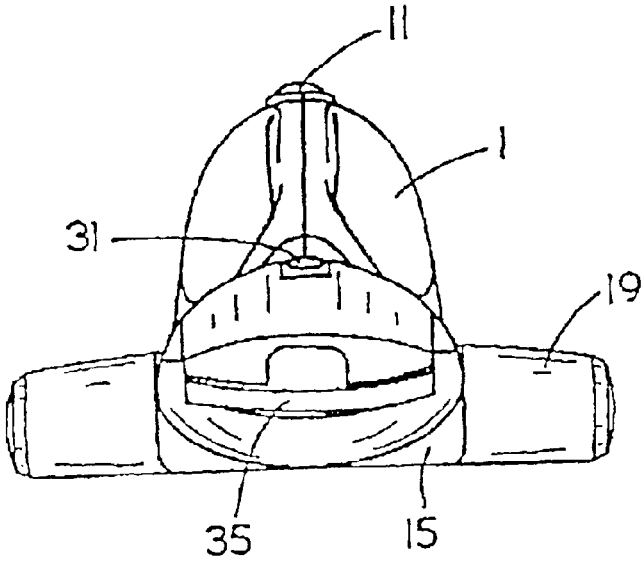

FIGS. 3 to 5 show the hand-held vacuum cleaner of FIG. 1 installed in the support caddy of FIG. 2. FIG. 4, which is an underside view shows the brush 118 housed within the suction inlet 116. Brush 118 can rotate. Rotation may simply be mechanical, by movement of the floor travelling head across a surface or, as in this particular case, be powered indirectly by the hand-held vacuum cleaner via motor 120. Appropriate electrical connections (not shown) may be present in the floor travelling head and hand-held vacuum cleaner for such indirect powering. FIG. 5, which is a rear end view shows in more detail the inlet 35 which is used for securement of the upper handle portion of the multi-operational vacuum cleaner of the invention as described in more detail below, especially with reference to FIGS. 7 to 9*b*.

In the form shown in FIGS. 3 to 5 with the hand-held vacuum cleaner secured to the support caddy 15, the multi-operational vacuum cleaner is operating in its second mode. It can be seen, especially with reference to FIG. 3, that in this mode the handle 7 of the hand-held vacuum cleaner 1 acts as the handle for the vacuum cleaner operating in its second mode. The floor travelling head 9 and brush 39 make it more suitable than the hand-held vacuum cleaner alone for picking up larger amounts of dust and debris, or for covering larger surfaces, but the short height of the cleaner in its second mode makes it especially suitable for cleaning raised surfaces or stairs or the like. Other advantageous applications of the cleaner in its second mode would be apparent to the man skilled in the art.

Figure 6:
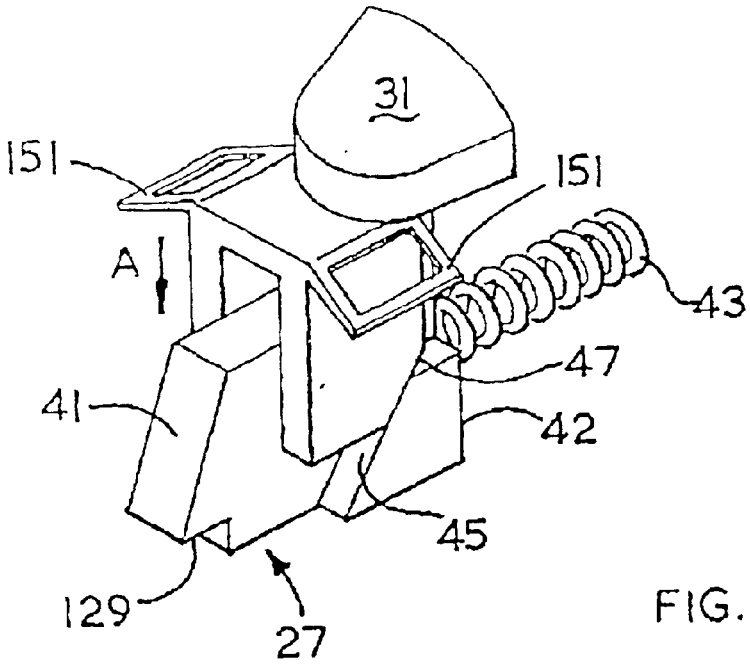
FIG. 6 is a perspective view of a first spring-biased latch member used to detachably secure the hand-held vacuum cleaner of FIG. 1 in the support caddy of FIG. 2.

FIG. 6 is a schematic perspective view showing the first latch member 27 that is used detachably to secure the hand-held vacuum cleaner 1 in the support caddy 15, as briefly described in FIG. 2. The first latch member 27 comprises a tapered front surface 41 and a generally flat back surface 42. The first latch member 27 is resiliently biased by a spring 43 acting on the back surface 42. The other end of the spring 43 is secured within the body of the rear end 29 of the support caddy 15 (see FIG. 2) so as to bias the surface 41 to project into the central portion 25 of the caddy, but this securement is not illustrated. The tapered front surface 41 of the first latch member 27 means that when the hand-held vacuum cleaner 1 is inserted into the support caddy 15 it engages and acts on the tapered surface 41 (downward force indicated by arrow "A" in FIG. 6) gradually to push it backwards against the bias of the spring 43, so that the latch 27 no longer projects from the surface of the caddy 15 and the hand-held vacuum cleaner 1 is further displaced into the caddy 15. Continued insertion of the cleaner 1 causes the first latch member 27 to become aligned with the recess 14 in the back of the hand held vacuum cleaner 1 (see FIG. 1) and the spring 43 urges the first latch member 27 to snap engage into the recess 14 so that the hand-held vacuum cleaner is securely held in place in the caddy 15 by a shoulder 129 of the first latch member 27.

Towards its back face 42 the latch member 27 is provided with a first cam surface 45. Release button 31 (see also FIG. 2) is also provided with a reciprocal cam surface 47 (referred to as the second cam surface in this specification). The button 31 is restrained, by the caddy clamshell, from longitudinal displacement relative to the latch member 27, and conversely the latch member is restrained from vertical displacement relative to the button 31. Subsequently, when button 31 is depressed (as shown in FIG. 6) the cam surface 47 moves over the cam surface 45 of the latch member 27 causing the latch member to move to the right and the spring 43 to compress. This therefore achieves retraction of the latch 27 to allow removal of the hand-held vacuum cleaner 1. When button 31 is released the spring 43 assumes its uncompressed state causing the latch member 27 to move to the left again. The subsequent reciprocal interaction of cam surfaces 45 and 47 thus serve to return button 31 to its unactuated position, and will retain this position until the hand-held vacuum cleaner 1 is re-inserted. Resiliently moulded integral wing portions 151 also serve to exert a biasing force on the button 31 urging it to return to an unactuated position.

Figure 7:
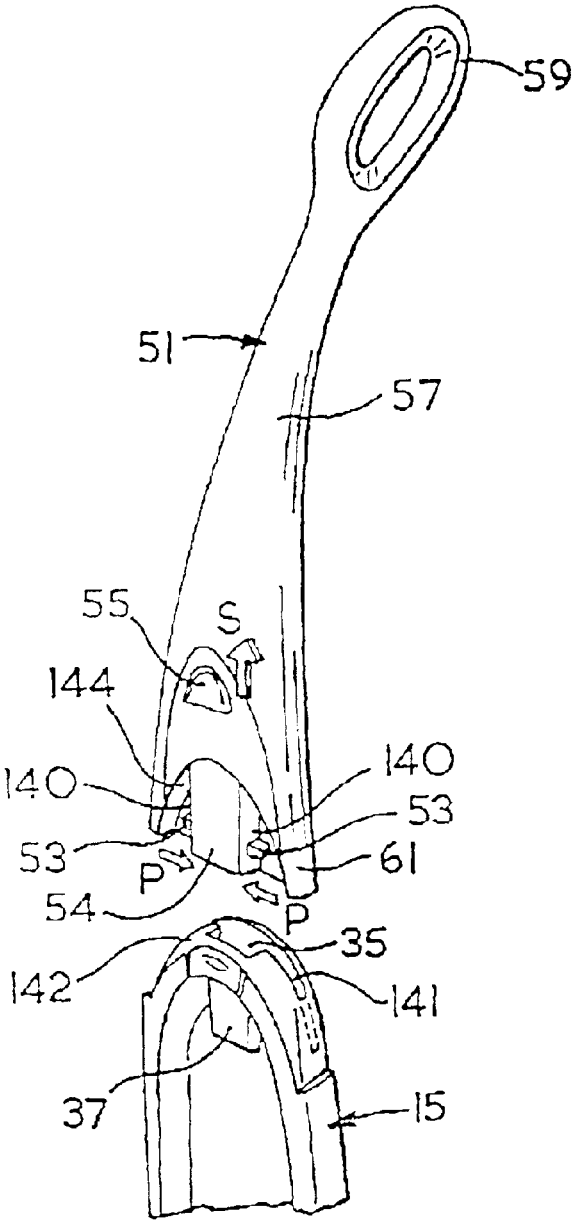
FIG. 7 is a schematic perspective view of part of the support caddy of FIG. 2 in combination with an upper handle portion, which is another component of a multi-operational vacuum cleaner according to the present invention, and can be used in conjunction with the hand-held vacuum cleaner and support caddy combination of FIGS. 3 to 5, the Figure showing schematically the second latch mechanism that detachably secures the upper handle portion to the support caddy.

FIG. 7 shows the upper end of the support caddy 15 and the upper handle portion 51, which is a third component of the multi-operational vacuum cleaner of the present invention. The upper handle portion 51 can not be used alone, but can be used in combination with the hand-held vacuum cleaner and support caddy combination of FIGS. 3 to 5 to provide the vacuum cleaner of the present invention operating in its third mode.

The upper handle portion 51 comprises a long stem 57 and a stem handle 59 at its upper end. The lower end 61 of the stem 57 of the upper handle portion 51 is provided with a latch member 53 (referred to elsewhere in the specification as the second latch member) which can be retracted, as indicated by arrows P, into a latch containing block 54. The latch member 53 comprises two end sections and a central spring member (not visible in FIG. 7). The retraction of the latch member 53 can occur automatically when the upper handle portion 51 is pushed into the inlet slot 35 of the support caddy 15, or maybe effected by sliding button 55 in the direction indicated by arrow S. When the upper handle portion 51 is pushed into the inlet 35 of the support caddy 15, the latch-containing block 54 of the upper handle portion 51 is contained within the member 37 in the flat surface 25 of the support caddy 15 (see also FIG. 2).

Figure 8:
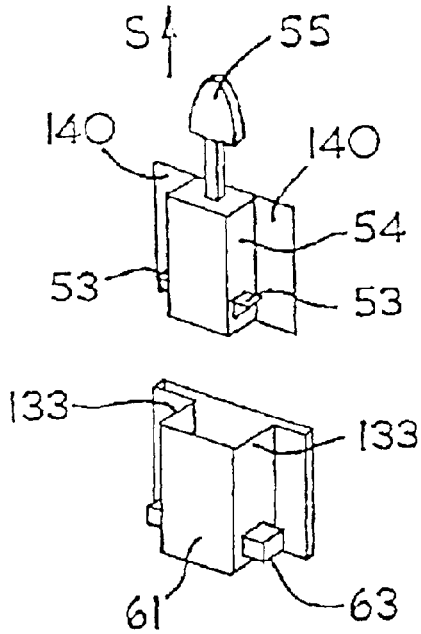
FIG. 8 is a schematic perspective view showing the internal portion of the support caddy that forms part of the second latch mechanism of FIG. 7.

FIG. 8 shows (schematically) that contained inside raised section 37 of the support caddy 15 there is a housing shell 61 integral with the caddy clamshell for receiving the latch-containing block 54 of the upper handle portion 51. The housing shell 61 comprises two hollow recesses 63 which act as recesses to each receive and retain a latch member 53.

Figure 9:
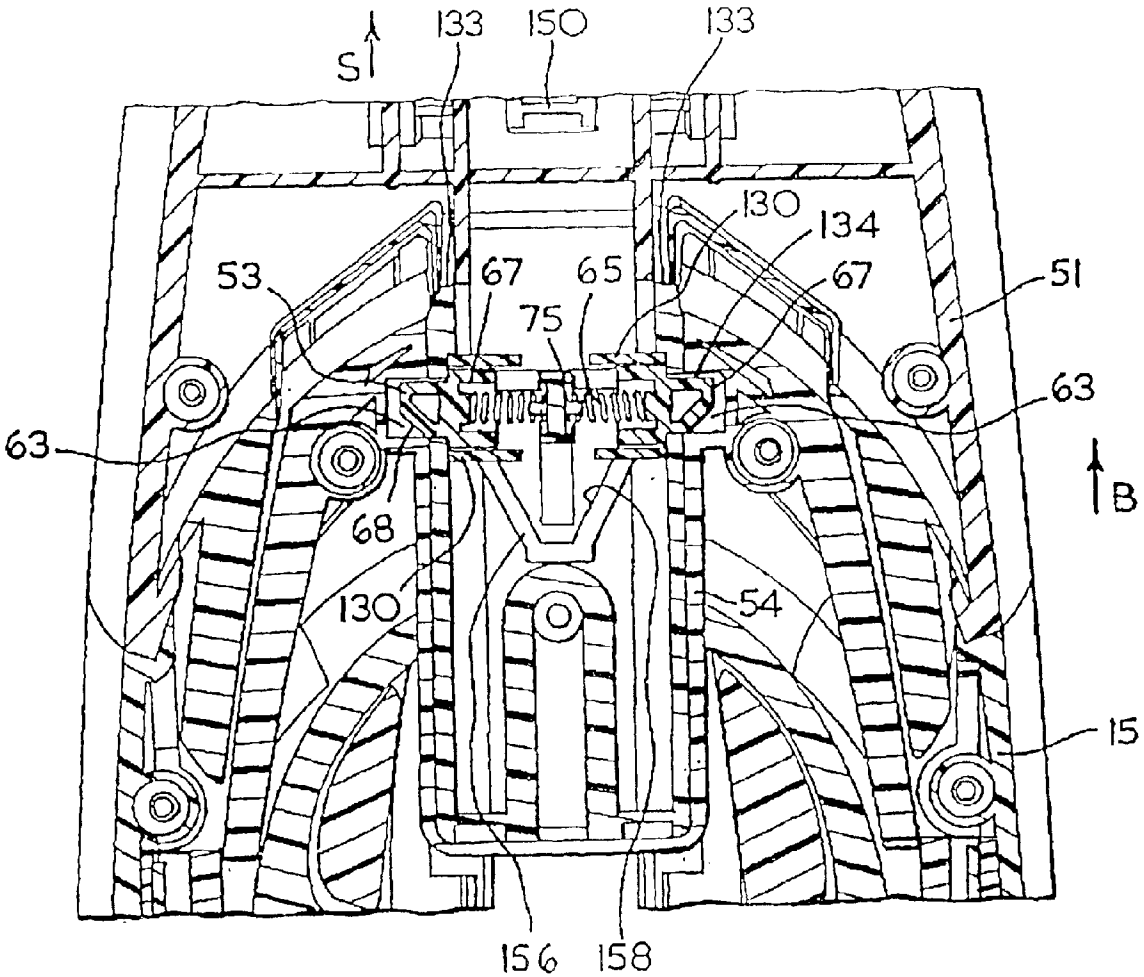
FIG. 9 is a sectional view showing in more detail the second latch mechanism of FIGS. 7 and 8.
Figure 10:
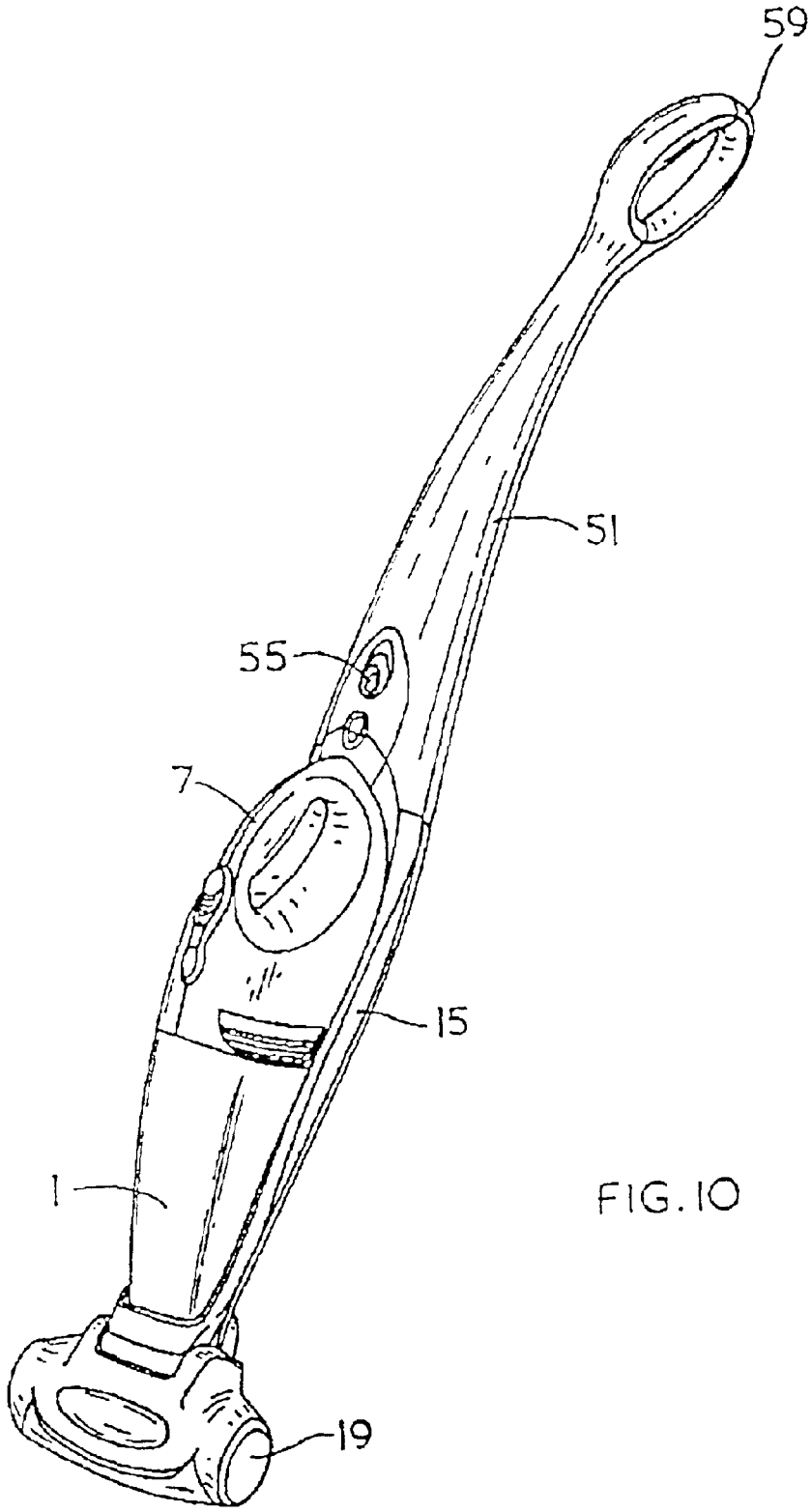
FIGS. 10 and 11 are perspective views of upper side and underneath side respectively of the hand-held vacuum cleaner and support caddy combination of FIGS. 3 to 5 with the additional upper handle portion of FIG. 7 secured to the support caddy.

FIG. 9, which shows a cross-sectional view through the handle 51 when engaged with the caddy 15, shows the basic operation of the latch member 53. The latch 52 comprises two opposed end portions 67 which are displaceable laterally (right to left in FIG. 9) relative to the elongate handle and are resiliently biased into an outward position as shown in FIG. 9 by a spring member 65. In this particular embodiment, each end portion 67 has an individual spring member 65 biased against a central pillar 75 but it will be appreciated that a single spring member could also be employed. Rib members 130 retain the end portions 67 from any longitudinal displacement. In this manner it will be appreciated that the end portion 67 can be pushed inwardly of their extreme outer positions against the resilient biasing of the spring 65. To help facilitate such displacement each end portion has an inclined cam surface 68 from which, it will be appreciated, any longitudinal engaging force in the direction B shown in FIG. 9 applied to such cam surfaces 68 will affect cam displacement of the end portion 67 against the resilient biasing of spring 65 into a compressed position and when such force is removed the natural biasing of the spring will again force the end portion 67 into their outermost positions shown in FIG. 9. Thus, referring now to FIG. 8 in combination with FIG. 9, the shell portion 61 of the caddy 15 comprises two hollow recesses 63 for each accommodating an end portion 67 of the latch. Again as can be seen from FIG. 8 the handle 51 has a latch containing block 54 which is received in a complementary fit within the shell 61 of the caddy. It will be appreciated from the schematic view shown in FIG. 8 that as the handle 51 is brought into engagement with the caddy the latch containing block 54 is received in a complementary fit within the shell 61 of the caddy. Continued displacement will bring the inclined cam surfaces 68 of the end portion 67 into abutment with a remote edge 133 of the shell whereby continued displacement of the handle towards the caddy will result in such end surfaces 133 applying a force in direction B shown in FIG. 9 against such cam surfaces 68 causing the cam deflection inwardly FIG. 9 so as to compress the spring member 65. Continued displacement then causes the shell 61 to pass over the compressed latch member 53 until the end portion 67 encounter the recesses 63 formed in the shell member 61 thereby, under the resilient biasing of the spring member 65, the end portion 67 are displaced outwardly of their compressed position so as to enter and engage with these recesses 63 so as to prevent the handle 51 from being withdrawn out of the caddy 15 by engagement of a flat shoulder 134 on the rear face of the end portion 67 with a corresponding shoulder formed in the recess 63. This engagement serves to lock the handle into a restrained position within the caddy 15. As illustrated in FIG. 10 it will be appreciated that engagement between the latch containing block 54 in complementary fit with the shell 61 provides a sturdy engagement between the handle and the caddy 15 and provides distribution for any stress created by engagement of the handle with the caddy when a leverage is applied to the handle portion 59 to be dissipated over a relatively large surface area between the handle and the caddy. Whereas the use of a rectangular shape of the latch containing block 54 in corresponding inlet 35, as opposed to a circular cross-section, restrains the handle from twisting relative to the caddy 15 when engaged. This feature is further emphasised by the side plates 140 (FIG. 7) disposed either side of the block 54 for slot engagement with corresponding slots 141 associated with the opening 35 in the caddy 15. Again engagement between these plates 140 and the slots 141 helps to distribute stress between the handle and the caddy over a larger surface area and restrains the handle from twisting relative to the caddy. As can also be seen from FIGS. 7 and 9 the rear surface 142 of the caddy then abuts against a corresponding shoulder 144 from the block 54. As can be seen from FIG. 7 this is substantially hemispherical and forms a complementary fit between the rear surface 142 and shoulder 144. Such a hemispherical interface again serves to prevent rotation of the handle relative to the caddy 15.

Figure 9A:
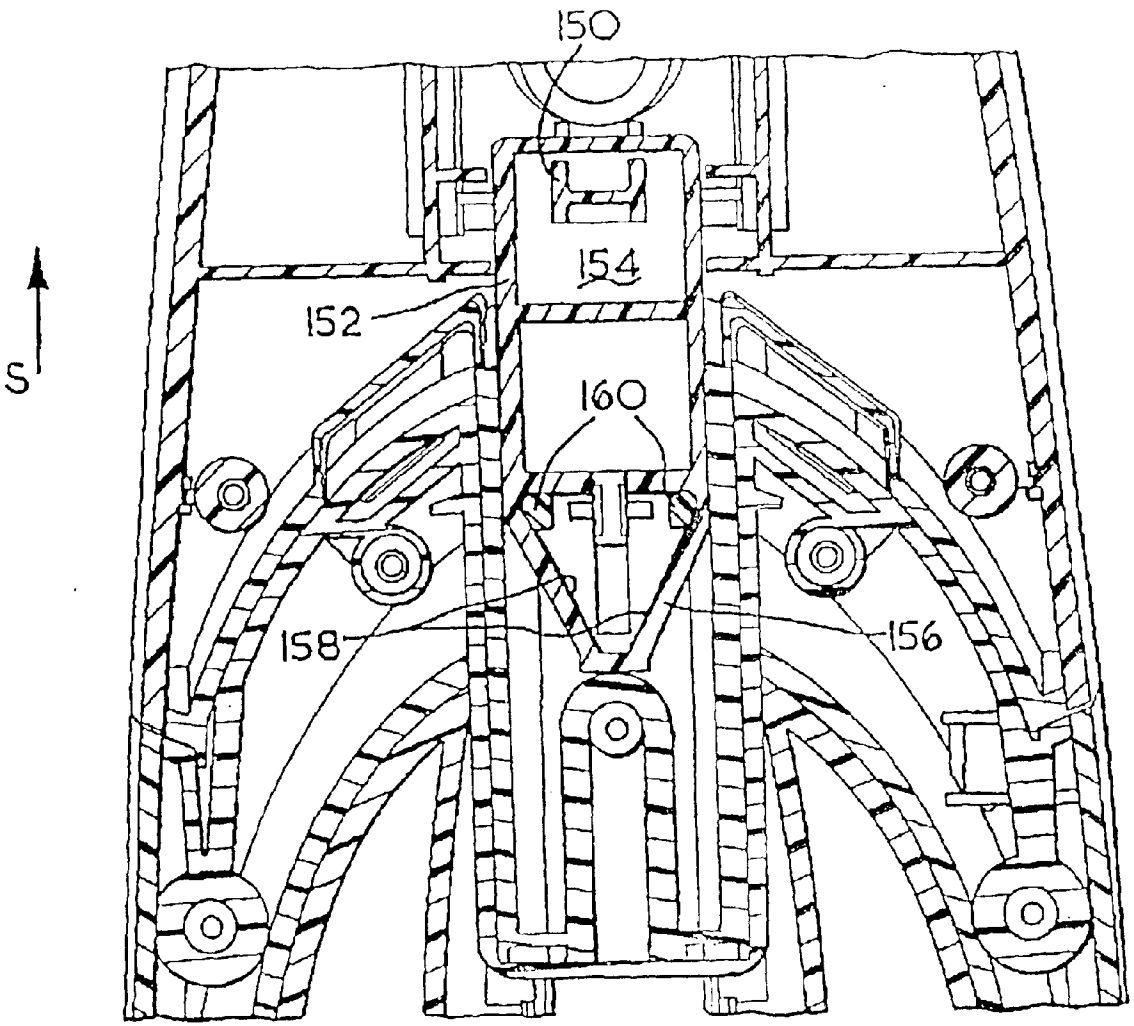
FIG. 9*a* is a second sectional view of the second latch mechanism of FIG. 9 through a section disposed between the sectional view of FIG. 9 and the upper surface of the handle and caddy.
Figure 9B:
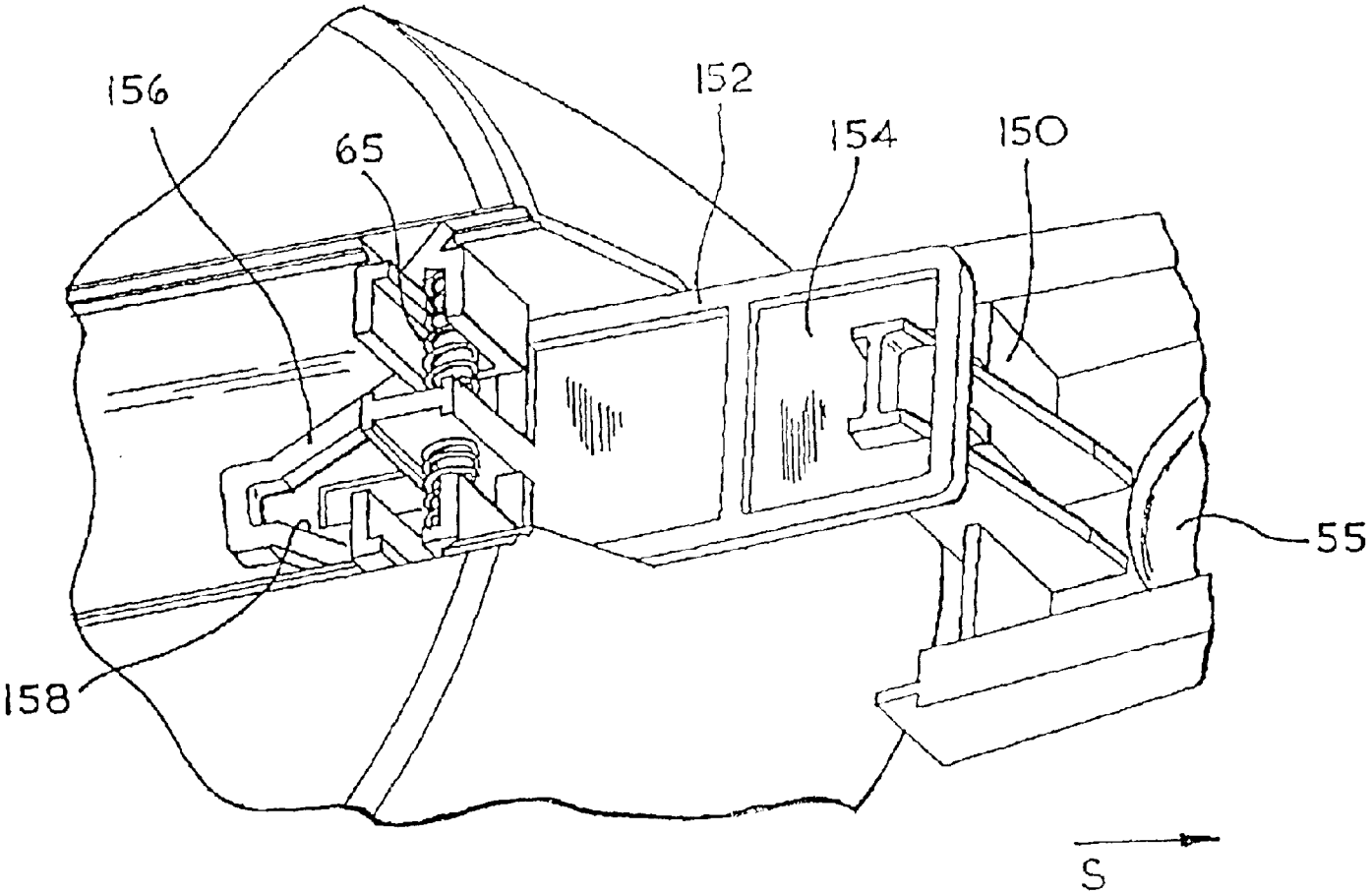
FIG. 9*b* is a perspective schematic view of the second latch mechanism of FIG. 9 from below.

In order to release this second latch member 53, the handle has mounted thereon longitudinally displaceable sliding button 55 which is displaceable in the direction shown generally as S in FIGS. 7 and 8. Slidable button 55 has an elongate member extending transversely with respect to the longitudinal direction of the handle which cannot be seen in FIGS. 7 and 8 but is shown schematically by the reference numeral 150 in FIGS. 9*a* and 9*b*. In this manner this member 150 can be displaced longitudinally by associated displacement of the button 55. This member 150 then engages with a solid cam deflector member 152 which comprises a substantially rectangular plate 154 having at its end remote from that to which the member 150 is connected, a tapered cam member 156 having two inner tapered cam surfaces 158. Both of the end portions 67 have mounted on an upper surface thereof two pin members 160 shown in 9*a*, which pins are received between the tapered cam surfaces 158 of the cam member 156. FIGS. 9, 9*a* and 9*b* show this cam member 156 in an unactuated position whereby the spring 65 has displaced the end portions 67 to their outermost position. These end portions 67 are restrained, as mentioned, from any longitudinal displacement by the rib members 130.

To unlatch the handle portion from the caddy 15 the slideable button 55 is displaced in the direction S as shown in FIGS. 7, 8 and 9*b* by such longitudinal displacement as transmitted by the member 150 to the cam member 152 and hence the cam surfaces 158. Displacements of the cam surfaces 158 in the direction S as seen in FIG. 9*a* causes engagement with the pin members 160 mounted on each of the end portions 67 which are subsequently deflected towards one another, which causes displacement of the end portions 67 against the resilient biasing of the spring 65 until such end portions 67 are no longer received within the projecting portions 63 of the housing shell 61 which thus allows the handle to be slideably removed from the caddy 15.

When the displacement force S is removed from the switch member 55 the biasing of the spring 65 then forces the end portion 67 outwardly of their compressed position and subsequently moves the pin members 160 against the tapering cam surfaces 158 so as to force the cam member 152 in a direction opposed to direction S as shown in FIG. 9*a* to return the slideable switch 55 to its original position.

Figure 11:
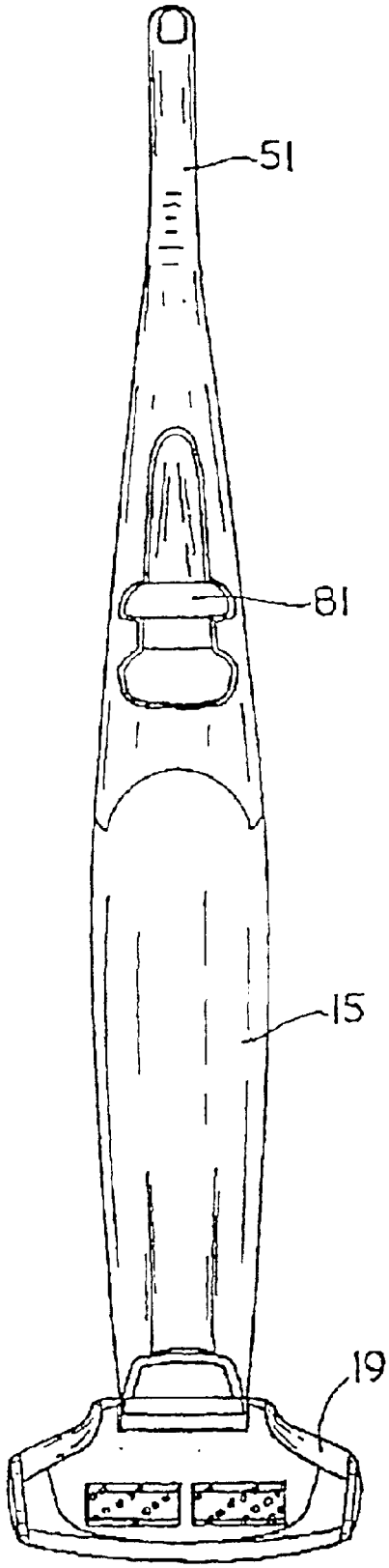

FIGS. 10 and 11 show the upper handle portion 51 secured to the support caddy 15 and hand-held vacuum cleaner combination. In FIG. 10 it can be seen that in this mode of operation the handle 59 of the upper handle portion 51 is the one that is used, not the handle 7 of the hand-held vacuum cleaner. Also from the rear view orientation of FIG. 11, a tool attachment storage 81 in the upper handle portion 51 is illustrated. The third mode of operation of the multi-operational vacuum cleaner of the invention, as illustrated in FIGS. 10 and 11 is traditional upright mode. It is useful for ease of cleaning from a standing position for regular floor cleaning. As with the other two modes of operation power for the operation is from the hand-held vacuum cleaner, and dust collection is also in the hand-held vacuum cleaner.

As illustrated by simple selection and combination of the three component parts (hand-held vacuum cleaner, support caddy, and upper handle portion) an operator can use the vacuum cleaner illustrated in three different modes depending on the application. It is therefore a three in one vacuum cleaner.

What is claimed is:

1. A multi-operational battery powered vacuum cleaner comprising:

(a) a hand held vacuum cleaner comprising a nose cone air flow inlet and a handle;

(b) a support caddy comprising a support member to which the hand held vacuum cleaner can be detachably secured, and a floor cleaning head attached to the support member; and (c) an upper handle portion that can be detachably secured to the support caddy;

wherein the vacuum cleaner system can operate: (i) in a first mode as the hand-held vacuum cleaner alone; (ii) in a second mode with the hand-held vacuum cleaner secured to the support caddy and operating in concert with the floor cleaning head; or (iii) in a third mode as in (ii) but further with the upper handle portion secured to the support caddy; and wherein the support member includes a first latch member biased by a spring, the spring of the first latch member being movable from an uncompressed state to a compressed state.

2. The vacuum cleaner according to claim 1, wherein the floor cleaning head is pivotally attached to the support member.

3. The vacuum cleaner according to claim 1, wherein the floor cleaning head comprises a rotatable brush.

4. The vacuum cleaner according to claim 3, wherein the brush is powered by a battery of the hand-held vacuum cleaner.

5. The vacuum cleaner according to claim 1, wherein the hand-held vacuum cleaner is attached to the support caddy; and wherein the handle of the hand-held vacuum cleaner system acts as the handle when the vacuum cleaner is operating in the second mode.

6. The vacuum cleaner according to claim 1, wherein the first spring-biased latch member is located in the support caddy, and the hand held vacuum cleaner comprises a recess shaped to receive the first spring-biased latch member when the spring is in its uncompressed state.

7. The vacuum cleaner system according to claim 6, wherein the spring of the first spring-biased latch member can be compressed to allow the first spring-biased latch member to be released from the latch-receiving-recess of the hand-held vacuum cleaner system so that the hand-held vacuum cleaner can be detached from the support caddy.

8. The vacuum cleaner system according to claim 1, wherein the first spring-biased latch member of the support caddy comprises a first cam surface, and a first release member comprising a co-operating second cam surface is also provided on the support caddy, whereby the release member can be moved relative to the first spring-biased latch member so that the first and second cam surfaces slide relative to each other to cause the spring of the first spring-biased latch member to move from its uncompressed to its compressed state.

9. The vacuum cleaner system according to claim 8, wherein the release member is a depressible button that can be depressed by an operator, depression of the button causing the first and second cam surfaces to move relative to each other.

10. The vacuum cleaner system according to claim 6, wherein the hand held vacuum cleaner has a rear end remote from its nose cone air flow inlet and the recess of the hand-held vacuum cleaner is at the said rear end, and the support caddy has a lower end and an upper end, the lower end comprising a nose engaging projection.

11. The vacuum cleaner system according to claim 10 which is arranged so that to install the hand-held vacuum cleaner in the support caddy the nose cone air flow inlet of the vacuum cleaner is first mounted on the nose engaging projection at the lower end of the support caddy, then the spring of the first spring-biased-latch member is compressed and positioned in line with the recess of the hand-held vacuum cleaner, and then the spring is released so that the latch engages the said recess; and so that to release the retained hand-held vacuum cleaner the spring of the first spring-biased latch member is compressed so that the latch disengages the latch-receiving-recess of the hand-held vacuum cleaner.

12. The vacuum cleaner according to claim 1, wherein the upper handle portion is detachably secured to the support caddy by a second spring-biased latch member; and wherein the second latch member comprises a central spring and at least one end caddy-engaging portion.

13. The vacuum cleaner system according to claim 12, wherein the second spring-biased latch member is located in the upper handle portion; and the support caddy comprises at least one recess adapted to receive the at least one caddy-engaging portions of the second spring-biased latch member.

14. The vacuum cleaner system according to claim 12, further comprising a second release member which can be moved relative to the second spring biased latch member to cause the central spring of the second spring-biased latch member to move from its uncompressed to its compressed state.

15. The vacuum cleaner system according to claim 14, wherein the second spring biased latch member comprises a third cam surface which slides relative to a fourth cam surface on the second release member to cause spring of the second spring-biased latch member to move from its uncompressed to its compressed state.

16. The vacuum cleaner system according to claim 15, wherein the second spring-biased latch member comprises a central spring and two end caddy-engaging portions; and wherein two third cam surfaces are provided on the second spring-biased latch member, one on each of the two end caddy-engaging portions of the second spring-biased latch member.

17. The vacuum cleaner system according to claim 16 wherein two fourth cam surfaces are provided on the second release member to co-operate with respective ones of the two third cam surfaces on the second spring-biased latch member; and wherein each said fourth cam surface is provided as a projecting surface on a back plate which can be moved relative to the second latch member.

18. A battery powered vacuum cleaner system comprising:

a hand held vacuum cleaner comprising an air flow inlet at a first end and a handle at a second end;

a support caddy comprising a support member including a latch member biased by a spring to which the hand held vacuum cleaner can be detachably secured in a nesting fashion;

said support caddy including a floor engaging head at a first end thereof adapted to fluidly communicate with said first end of said hand held vacuum cleaner, said support caddy further including a second end spaced apart from said first end;

an upper handle portion that can be detachably secured to said second end of said support caddy; and wherein said system can operate in a plurality of operating modes including:

a first cleaning mode wherein only said hand held vacuum cleaner is used for cleaning purposes; and a second cleaning mode wherein said hand held vacuum cleaner is secured on said support caddy and said upper handle portion is secured to said support caddy and is grasped by a user to allow said system to function as an upright vacuum cleaner.

19. The vacuum cleaner system of claim 18, wherein said floor engaging head is pivotally secured to said support caddy.

20. The vacuum cleaner system of claim 19, wherein said floor engaging head comprises a rotatable brush.

21. The vacuum cleaner system of claim 18, wherein:

said hand held vacuum cleaner is detachably secured to said support caddy by a first latch member biased by a spring;

said latch member being disposed in said support caddy;

said hand held vacuum cleaner including a recess shaped to received said latch member when said spring is in an uncompressed state, said spring being movable from said uncompressed state to a compressed state to release said latch member from said recess, to thereby enable said hand held vacuum cleaner to be removed from said support caddy.

22. The vacuum cleaner system of claim 21, wherein:

said latch member comprises a first cam surface;

said support caddy comprises a release member having a cooperating second cam surface; and wherein said release member can be moved relative to the latch member so that the first and second cam surfaces slide relative to each other to cause the spring of the latch member to move from its said uncompressed state to its said compressed state.

23. A battery powered vacuum cleaner system comprising:

a hand held vacuum cleaner comprising an air flow inlet at a first end and a handle at a second end;

a support caddy comprising a support member including a latch member baised by a spring to which the hand held vacuum cleaner can be detachably secured in a nesting fashion;

said support caddy including a first end at which is coupled a floor engaging head adapted to fluidly communicate with said first end of said hand held vacuum cleaner, said support caddy further including a second end spaced apart from said first end;

an upper handle portion that can be detachably via a spring biased latching system secured to said second end of said support caddy; and wherein said system can operate in a plurality of operating modes including:

a first cleaning mode wherein only said hand held vacuum cleaner is used for cleaning purposes;

a second cleaning mode wherein said hand held vacuum cleaner is secured on said support caddy and said upper handle portion is secured to said support caddy and is grasped by a user to allow said system to function as an upright vacuum cleaner; and a third cleaning mode wherein the hand held vacuum cleaner is operated while mounted on said support caddy but without said upper handle portion.

24. The vacuum cleaner system of claim 23, further comprising a latching system operably associated with said support caddy and said upper handle portion for detachably securing said upper handle portion to said support caddy.

25. The vacuum cleaner system of claim 24, further comprising a release member for urging said latching system into an unlatched condition, whereby said upper handle portion can be removed from said support caddy.

26. The vacuum cleaner system of claim 33, further comprising a release member for urging said latch member into an unlatched condition, whereby said hand held vacuum cleaner can be removed from said support caddy.

27. A method for forming a vacuum cleaning system, comprising:

using a hand held, battery powered vacuum cleaner to directly clean a surface, thereby forming a first operational mode;

using a support caddy having a floor engaging head and a support member including a latch member biased by a spring to support said hand held vacuum cleaner thereon, wherein said vacuum cleaner includes a nose cone in airflow communication with said floor engaging head such that a suction airflow from said hand held vacuum cleaner is directed through said floor engaging head, thereby forming a second operational mode; and using a handle detachably coupled to said support caddy via a spring biased latching system to enable a user to use said support caddy and said hand held battery powered vacuum cleaner secured to said support caddy as an upright vacuum cleaning device, in accordance with a third operational mode, to thus form said vacuum cleaner system.

28. The vacuum cleaner of claim 18, wherein the upper handle portion is secured to said support caddy by a spring biased latch member.

* * * * *

UNITED STATES PATENT AND TRADEMARK OFFICE

CERTIFICATE OF CORRECTION

PATENT NO. : 6,839,934 B2
DATED : January 11, 2005
INVENTOR(S) : Stephen Houghton et al.

It is certified that error appears in the above-identified patent and that said Letters Patent is hereby corrected as shown below:

Tilte page,
Item [73], Assignee, "Neward" should be -- Newark --.

Column 14,
Line 3, "received" should be -- receive --.
Line 56, "claim 33" should be -- claim 23 --.

Signed and Sealed this

Seventh Day of February, 2006

JON W. DUDAS
*Director of the United States Patent and Trademark Office*